US009316951B1

(12) United States Patent
Denton et al.

(10) Patent No.: US 9,316,951 B1
(45) Date of Patent: Apr. 19, 2016

(54) MAGNETIC ROLL HAVING A SMOOTHED RELEASE POLE FOR A DUAL COMPONENT DEVELOPMENT ELECTROPHOTOGRAPHIC IMAGE FORMING DEVICE

(71) Applicant: Lexmark International, Inc., Lexington, KY (US)

(72) Inventors: Gary Allen Denton, Lexington, KY (US); Katherine Marie Gilliam, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/875,767

(22) Filed: Oct. 6, 2015

(51) Int. Cl.
*G03G 15/09* (2006.01)

(52) U.S. Cl.
CPC ..... *G03G 15/0928* (2013.01)

(58) Field of Classification Search
USPC ..... 399/119, 252, 258, 259, 265–269, 272, 399/276, 277, 279, 281, 282, 286
See application file for complete search history.

(56) References Cited

U.S. PATENT DOCUMENTS 7,116,932 B2 * 10/2006 Takeuchi ..... G03G 15/0921 399/274
9,057,988 B2 * 6/2015 Nakayama ..... G03G 15/0921

OTHER PUBLICATIONS

Attatched Information Disclosure Statement cotaining graphs illustrating the magnetic profiles of prior art magnetic rolls.

* cited by examiner

*Primary Examiner* — Hoan Tran
(74) *Attorney, Agent, or Firm* — Justin M Tromp

(57) ABSTRACT

A magnetic roll for transporting a dual component developer mix according to one embodiment includes a core having at least one permanent magnet that has a plurality of circumferentially spaced magnetic poles generating a magnetic field. A cylindrical sleeve is positioned around the core. The sleeve is rotatable relative to the core about a rotational axis in an operative rotational direction. At portions of the magnetic roll positioned axially inward from axial ends of the core, a magnitude of a total magnetic field strength of the magnetic field decreases by 1.5 mT/degree or less in the operative rotational direction at a radius of 0.5 mm beyond an outer circumferential surface of the sleeve throughout an area of ±15 degrees from an angular position of the magnetic roll at which a tangential component of the magnetic field is equal to zero at a release pole of the plurality of magnetic poles.

2 Claims, 14 Drawing Sheets

Example Magnetic Profile #8

MAGNETIC ROLL HAVING A SMOOTHED RELEASE POLE FOR A DUAL COMPONENT DEVELOPMENT ELECTROPHOTOGRAPHIC IMAGE FORMING DEVICE

CROSS REFERENCES TO RELATED APPLICATIONS

None.

BACKGROUND

1. Field of the Disclosure

The present disclosure relates generally to image forming devices and more particularly to a magnetic roll having a smoothed release pole for a dual component development electrophotographic image forming device.

2. Description of the Related Art

Dual component development electrophotographic image forming devices include one or more reservoirs that store a mixture of toner and magnetic carrier beads (the "developer mix"). Toner is electrostatically attracted to the carrier beads as a result of triboelectric interaction between the toner and the carrier beads. A magnetic roll includes a stationary core having one or more permanent magnets and a sleeve that rotates around the core. The permanent magnet(s) produce a series of magnetic poles that are circumferentially spaced around the outer surface of the sleeve. The magnetic poles attract the carrier beads in the reservoir having toner thereon to the outer surface of the sleeve, which transports the developer mix as the sleeve rotates. A photoconductive drum is charged by a charge roll to a predetermined voltage and a laser selectively discharges areas on the surface of the photoconductive drum to form a latent image on the surface of the photoconductive drum. The sleeve of the magnetic roll carries the developer mix in close proximity to the photoconductive drum. The sleeve is electrically biased to facilitate the transfer of toner from the chains of developer mix on the outer surface of the sleeve to the discharged areas on the surface of the photoconductive drum forming a toner image on the surface of the photoconductive drum. The photoconductive drum then transfers the toner image, directly or indirectly, to a media sheet forming a printed image on the media sheet. Developer mix on the outer surface of the sleeve that is not transferred to the photoconductive drum is transported by the sleeve back to the reservoir. After the remaining developer mix reenters the reservoir, the developer mix is no longer magnetically retained against the outer surface of the sleeve allowing the developer mix to release from the sleeve back into the reservoir.

It is desired for the magnetic poles to be configured to facilitate pick up of the developer mix from the reservoir, transfer of toner from the developer mix on the magnetic roll to the photoconductive drum and release of the developer mix back into the reservoir.

SUMMARY

A magnetic roll for transporting a developer mix that includes magnetic carrier beads and toner in a dual component development electrophotographic image forming device according to one example embodiment includes a core having at least one permanent magnet. The permanent magnet has a plurality of circumferentially spaced magnetic poles generating a magnetic field. The plurality of magnetic poles includes a release pole. A cylindrical sleeve is positioned around the core. The sleeve is rotatable relative to the core about an axis of rotation in an operative rotational direction. The release pole is positioned to magnetically attract developer mix to an outer circumferential surface of the sleeve and thereby transport the developer mix on the outer circumferential surface of the sleeve in the operative rotational direction when the sleeve rotates relative to the core to a point where a magnitude of a total magnetic field strength of the magnetic field falls below 15 mT. At portions of the magnetic roll positioned axially inward from axial ends of the core where an axial component of the magnetic field is <1 mT, the magnitude of the total magnetic field strength of the magnetic field decreases by 1.5 mT/degree or less in the operative rotational direction at a radius of 0.5 mm radially beyond the outer circumferential surface of the sleeve throughout an area of ±15 degrees from an angular position of the magnetic roll at which a tangential component of the magnetic field is equal to zero at the release pole. In some embodiments, the magnitude of the total magnetic field strength of the magnetic field decreases by 1.3 mT/degree or less, or 1.0 mT/degree or less.

A developer unit for dual component development electrophotographic image forming device according to one example embodiment includes a housing having a reservoir for storing a developer mix that includes toner and magnetic carrier beads. The developer unit includes a magnetic roll that includes a stationary core and a cylindrical sleeve positioned around the core. The core includes at least one permanent magnet having a plurality of circumferentially spaced magnetic poles generating a magnetic field. The plurality of magnetic poles includes a release pole. The sleeve is rotatable relative to the core about an axis of rotation in an operative rotational direction. An outer circumferential surface of the sleeve is positioned to transport developer mix magnetically attracted from the reservoir to the outer surface of the sleeve by the magnetic field in the operative rotation direction. The release pole is positioned to magnetically attract developer mix to the outer circumferential surface of the sleeve to transport the developer mix on the outer circumferential surface of the sleeve in the operative rotational direction to a point where the developer mix is released from the outer circumferential surface of the sleeve into the reservoir. At portions of the magnetic roll positioned axially inward from axial ends of the core where an axial component of the magnetic field is <1 mT, a magnitude of a total magnetic field strength of the magnetic field decreases by 1.5 mT/degree or less in the operative rotational direction at a radius of 0.5 mm radially beyond the outer circumferential surface of the sleeve throughout an area of ±15 degrees from an angular position of the magnetic roll at which a tangential component of the magnetic field is equal to zero at the release pole. In some embodiments, the magnitude of the total magnetic field strength of the magnetic field decreases by 1.3 mT/degree or less, or 1.0 mT/degree or less.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
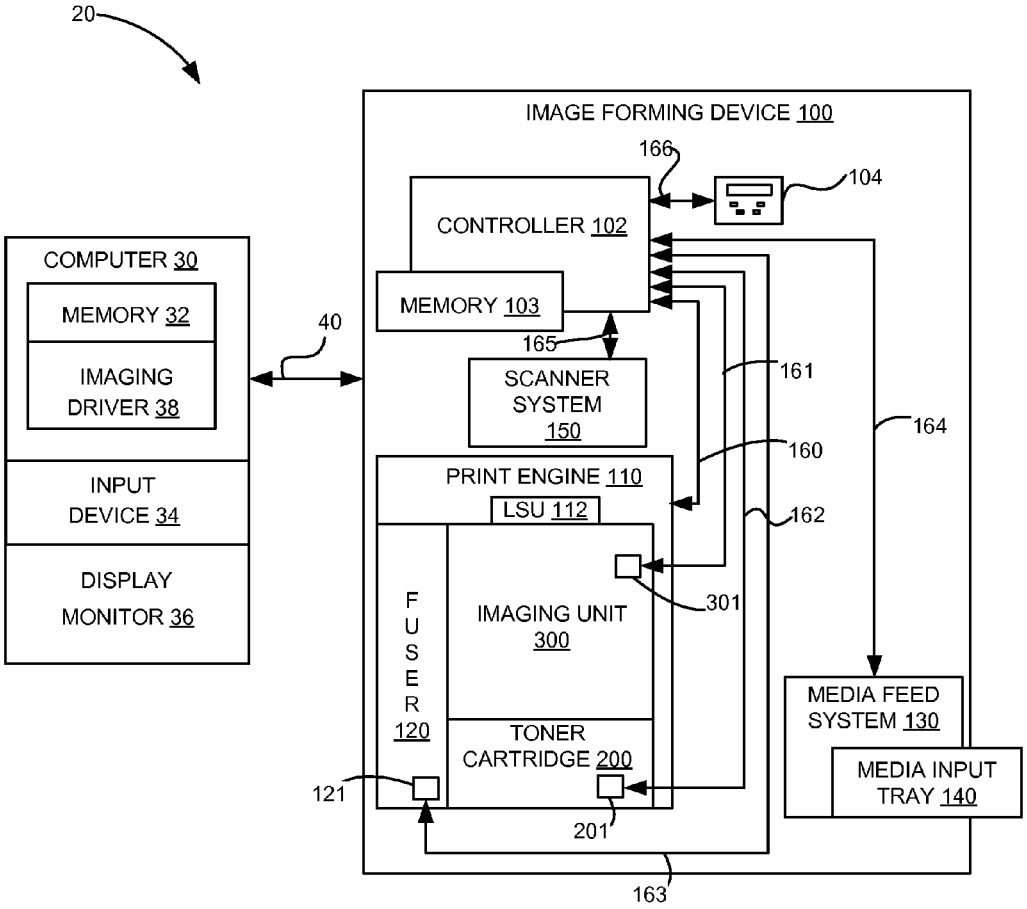
FIG. 1 is a block diagram depiction of an imaging system according to one example embodiment.

Referring now to the drawings and more particularly to FIG. 1, there is shown a block diagram depiction of an imaging system 20 according to one example embodiment. Imaging system 20 includes an image forming device 100 and a computer 30. Image forming device 100 communicates with computer 30 via a communications link 40. As used herein, the term "communications link" generally refers to any structure that facilitates electronic communication between multiple components and may operate using wired or wireless technology and may include communications over the Internet.

In the example embodiment shown in FIG. 1, image forming device 100 is a multifunction machine (sometimes referred to as an all-in-one (AIO) device) that includes a controller 102, a print engine 110, a laser scan unit (LSU) 112, one or more toner bottles or cartridges 200, one or more imaging units 300, a fuser 120, a user interface 104, a media feed system 130 and media input tray 140 and a scanner system 150. Image forming device 100 may communicate with computer 30 via a standard communication protocol, such as, for example, universal serial bus (USB), Ethernet or IEEE 802.xx. Image forming device 100 may be, for example, an electrophotographic printer/copier including an integrated scanner system 150 or a standalone electrophotographic printer.

Controller 102 includes a processor unit and associated memory 103. The processor may include one or more integrated circuits in the form of a microprocessor or central processing unit and may be formed as one or more Application Specific Integrated Circuits (ASICs). Memory 103 may be any volatile or non-volatile memory or combination thereof, such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may be, for example, a combined printer and scanner controller.

In the example embodiment illustrated, controller 102 communicates with print engine 110 via a communications link 160. Controller 102 communicates with imaging unit(s) 300 and processing circuitry 301 on each imaging unit 300 via communications link(s) 161. Controller 102 communicates with toner cartridge(s) 200 and processing circuitry 201 on each toner cartridge 200 via communications link(s) 162. Controller 102 communicates with fuser 120 and processing circuitry 121 thereon via a communications link 163. Controller 102 communicates with media feed system 130 via a communications link 164. Controller 102 communicates with scanner system 150 via a communications link 165. User interface 104 is communicatively coupled to controller 102 via a communications link 166. Processing circuitry 121, 201, 301 may include a processor and associated memory, such as RAM, ROM, and/or NVRAM, and may provide authentication functions, safety and operational interlocks, operating parameters and usage information related to fuser 120, toner cartridge(s) 200 and imaging units 300, respectively. Controller 102 processes print and scan data and operates print engine 110 during printing and scanner system 150 during scanning.

Computer 30, which is optional, may be, for example, a personal computer, including memory 32, such as RAM, ROM, and/or NVRAM, an input device 34, such as a keyboard and/or a mouse, and a display monitor 36. Computer 30 also includes a processor, input/output (I/O) interfaces, and may include at least one mass data storage device, such as a hard drive, a CD-ROM and/or a DVD unit (not shown). Computer 30 may also be a device capable of communicating with image forming device 100 other than a personal computer, such as, for example, a tablet computer, a smartphone, or other electronic device.

In the example embodiment illustrated, computer 30 includes in its memory a software program including program instructions that function as an imaging driver 38, e.g., printer/scanner driver software, for image forming device 100. Imaging driver 38 is in communication with controller 102 of image forming device 100 via communications link 40. Imaging driver 38 facilitates communication between image forming device 100 and computer 30. One aspect of imaging driver 38 may be, for example, to provide formatted print data to image forming device 100, and more particularly to print engine 110, to print an image. Another aspect of imaging driver 38 may be, for example, to facilitate the collection of scanned data from scanner system 150.

In some circumstances, it may be desirable to operate image forming device 100 in a standalone mode. In the standalone mode, image forming device 100 is capable of functioning without computer 30. Accordingly, all or a portion of imaging driver 38, or a similar driver, may be located in controller 102 of image forming device 100 so as to accommodate printing and/or scanning functionality when operating in the standalone mode.

Figure 2:
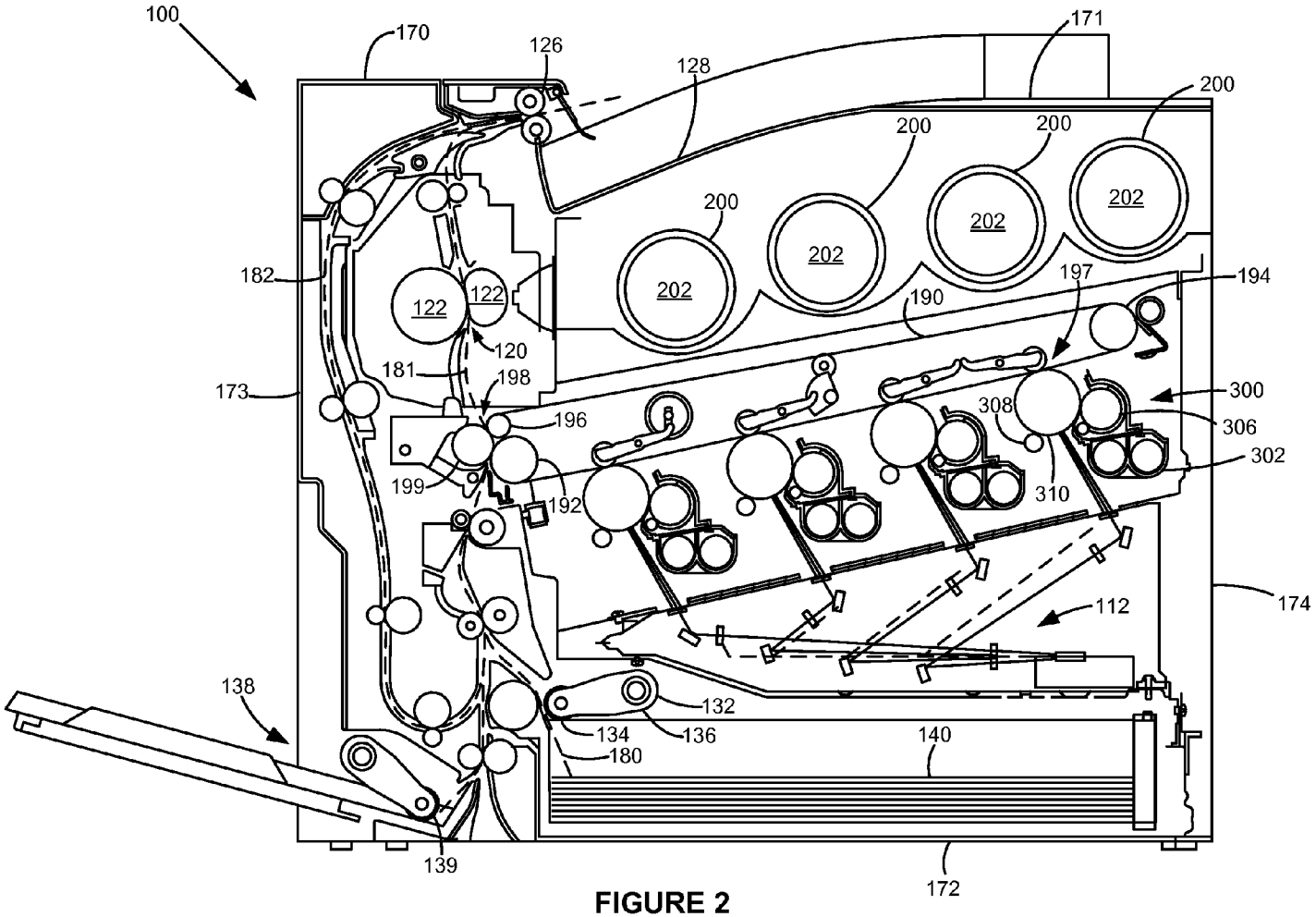
FIG. 2 is a schematic diagram of an image forming device according to one example embodiment.

FIG. 2 illustrates a schematic view of the interior of an example image forming device 100. For purposes of clarity, the components of only one of the imaging units 300 are labeled in FIG. 2. Image forming device 100 includes a housing 170 having a top 171, bottom 172, front 173 and rear 174. Housing 170 includes one or more media input trays 140 positioned therein. Trays 140 are sized to contain a stack of media sheets. As used herein, the term media is meant to encompass not only paper but also labels, envelopes, fabrics, photographic paper or any other desired substrate. Trays 140 are preferably removable for refilling. A media path 180 extends through image forming device 100 for moving the media sheets through the image transfer process. Media path 180 includes a simplex path 181 and may include a duplex path 182. A media sheet is introduced into simplex path 181 from tray 140 by a pick mechanism 132. In the example embodiment shown, pick mechanism 132 includes a roll 134 positioned at the end of a pivotable arm 136. Roll 134 rotates to move the media sheet from tray 140 and into media path 180. The media sheet is then moved along media path 180 by various transport rollers. Media sheets may also be introduced into media path 180 by a manual feed 138 having one or more rolls 139.

In the example embodiment shown, image forming device 100 includes four toner cartridges 200 removably mounted in housing 170 in a mating relationship with four corresponding imaging units 300, which may also be removably mounted in housing 170. Each toner cartridge 200 includes a reservoir 202 for holding toner and an outlet port in communication with an inlet port of its corresponding imaging unit 300 for transferring toner from reservoir 202 to imaging unit 300. Toner is transferred periodically from a respective toner cartridge 200 to its corresponding imaging unit 300 in order to replenish the imaging unit 300. In the example embodiment illustrated, each toner cartridge 200 is substantially the same except for the color of toner contained therein. In one embodiment, the four toner cartridges 200 include yellow, cyan, magenta and black toner.

Image forming device 100 utilizes what is commonly referred to as a dual component development system. Each imaging unit 300 includes a reservoir 302 that stores a mixture of toner and magnetic carrier beads. The carrier beads may be coated with a polymeric film to provide triboelectric properties to attract toner to the carrier beads as the toner and the carrier beads are mixed in reservoir 302. Reservoir 302 and a magnetic roll 306 collectively form a developer unit. Each imaging unit 300 also includes a charge roll 308 and a photoconductive (PC) drum 310 and a cleaner blade or roll (not shown) that collectively form a PC unit. PC drums 310 are mounted substantially parallel to each other when the imaging units 300 are installed in image forming device 100. In the example embodiment illustrated, each imaging unit 300 is substantially the same except for the color of toner contained therein.

Each charge roll 308 forms a nip with the corresponding PC drum 310. During a print operation, charge roll 308 charges the surface of PC drum 310 to a specified voltage, such as, for example, −1000 volts. A laser beam from LSU 112 is then directed to the surface of PC drum 310 and selectively discharges those areas it contacts to form a latent image. In one embodiment, areas on PC drum 310 illuminated by the laser beam are discharged to approximately −300 volts. Magnetic roll 306 attracts the carrier beads in reservoir 302 having toner thereon to magnetic roll 306 through the use of magnetic fields and transports the toner to the corresponding PC drum 310. Electrostatic forces from the latent image on PC drum 310 strip the toner from the carrier beads to form a toner image on the surface of PC drum 310.

An intermediate transfer mechanism (ITM) 190 is disposed adjacent to the PC drums 310. In this embodiment, ITM 190 is formed as an endless belt trained about a drive roll 192, a tension roll 194 and a back-up roll 196. During image forming operations, ITM 190 moves past PC drums 310 in a clockwise direction as viewed in FIG. 2. One or more of PC drums 310 apply toner images in their respective colors to ITM 190 at a first transfer nip 197. In one embodiment, a positive voltage field attracts the toner image from PC drums 310 to the surface of the moving ITM 190. ITM 190 rotates and collects the one or more toner images from PC drums 310 and then conveys the toner images to a media sheet at a second transfer nip 198 formed between a transfer roll 199 and ITM 190, which is supported by back-up roll 196. The cleaner blade/roll removes any toner remnants on PC drum 310 so that the surface of PC drum 310 may be charged and developed with toner again.

A media sheet advancing through simplex path 181 receives the toner image from ITM 190 as it moves through the second transfer nip 198. The media sheet with the toner image is then moved along the media path 180 and into fuser 120. Fuser 120 includes fusing rolls or belts 122 that form a nip to adhere the toner image to the media sheet. The fused media sheet then passes through exit rolls 126 located downstream from fuser 120. Exit rolls 126 may be rotated in either forward or reverse directions. In a forward direction, exit rolls 126 move the media sheet from simplex path 181 to an output area 128 on top 171 of image forming device 100. In a reverse direction, exit rolls 126 move the media sheet into duplex path 182 for image formation on a second side of the media sheet.

While the example image forming device 100 shown in FIG. 2 illustrates four toner cartridges 200 and four corresponding imaging units 300, it will be appreciated that a monocolor image forming device 100 may include a single toner cartridge 200 and corresponding imaging unit 300 as compared to a color image forming device 100 that may include multiple toner cartridges 200 and imaging units 300.

Further, although image forming device 100 utilizes ITM 190 to transfer toner to the media, toner may be applied directly to the media by the one or more photoconductive drums 310 as is known in the art. In addition, toner may be transferred directly from each toner cartridge 200 to its corresponding imaging unit 300 or the toner may pass through an intermediate component, such as a chute, duct or hopper, that connects the toner cartridge 200 with its corresponding imaging unit 300.

Imaging unit(s) 300 may be replaceable in any combination desired. For example, in one embodiment, the developer unit and PC unit are provided in separate replaceable units from each other. In another embodiment, the developer unit and PC unit are provided in a common replaceable unit. In another embodiment, toner reservoir 202 is provided with the developer unit instead of in a separate toner cartridge 200. For a color image forming device 100, the developer unit and PC unit of each color toner may be separately replaceable or the developer unit and/or the PC unit of all colors (or a subset of all colors) may be replaceable collectively as desired.

Figure 3:
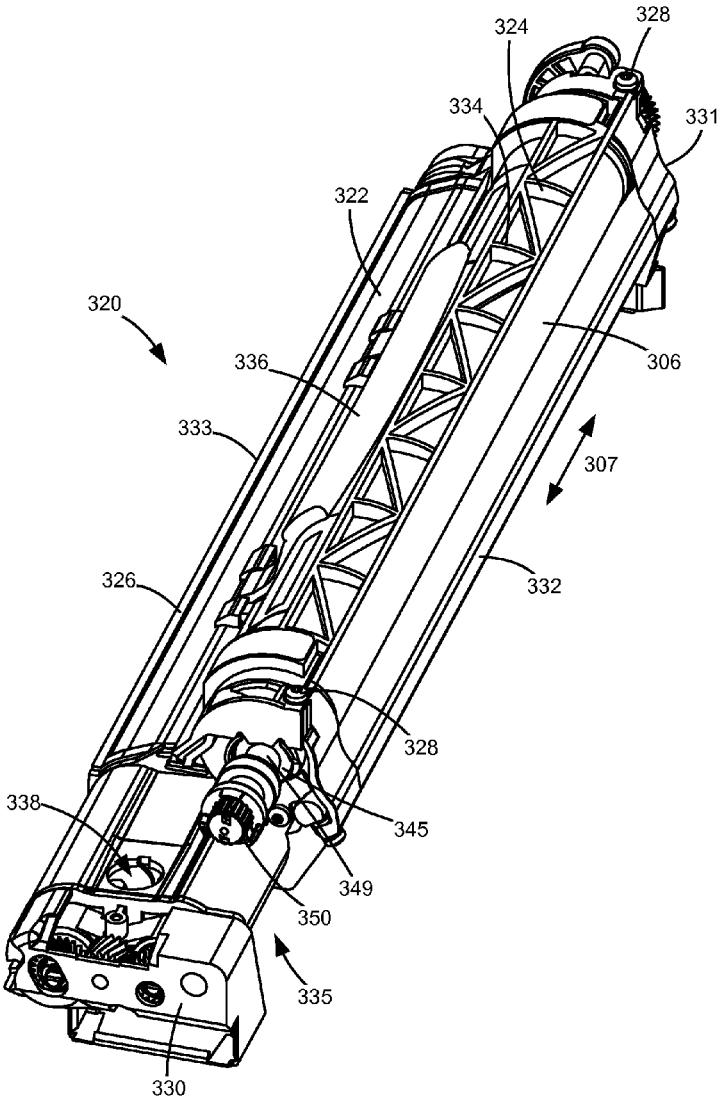
FIG. 3 is a perspective view of a developer unit according to one example embodiment.
Figure 4:
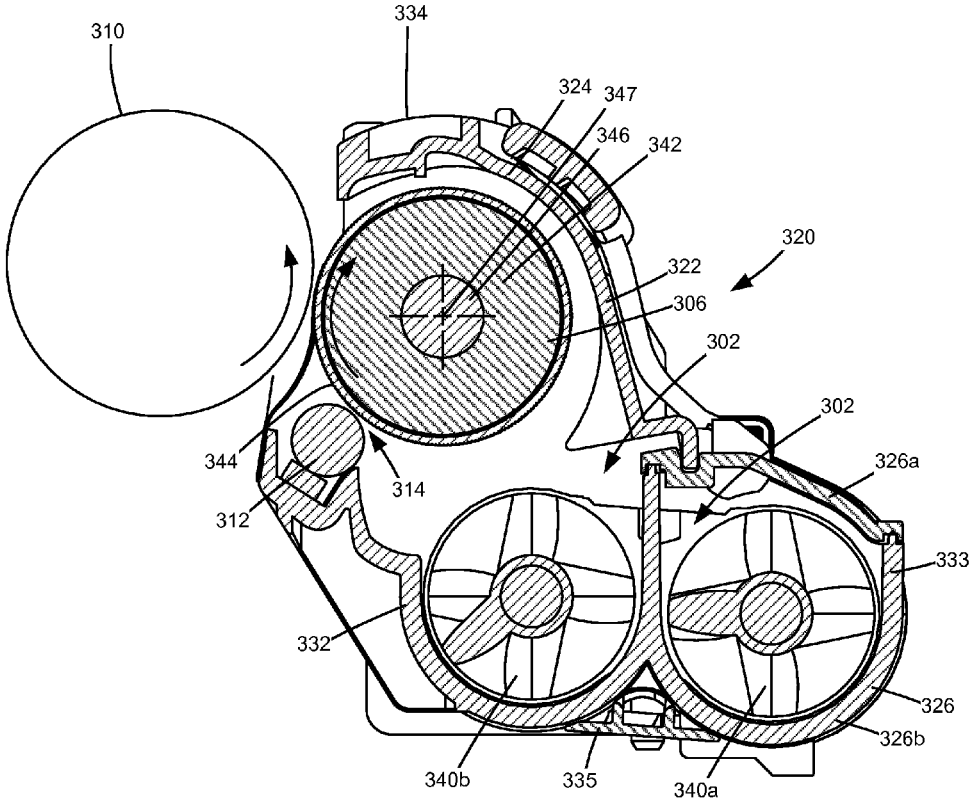
FIG. 4 is a cross-sectional view of the developer unit shown in FIG. 3.

FIGS. 3 and 4 show a developer unit 320 according to one example embodiment. Developer unit 320 includes a housing 322 having reservoir 302 therein. In some embodiments, housing 322 includes a lid 324 mounted on a base 326. Lid 324 may be attached to base 326 by any suitable construction including, for example, by fasteners (e.g., screws 328), adhesive and/or welding. Alternatively, lid 324 may be formed integrally with base 326. In the example embodiment illustrated, base 326 includes a top portion 326*a* attached (e.g., by fasteners, adhesive and/or welding) to a lower portion 326*b*. Alternatively, top portion 326*a* of base 326 may be formed integrally with lower portion 326*b* of base 326. Housing 322 extends generally along an axial dimension 307 of magnetic roll 306 from a first side 330 of housing 322 to a second side 331 of housing 322. Side 330 leads during insertion of developer unit 320 into image forming device 100 and side 331 trails. A portion of magnetic roll 306 is exposed from reservoir 302 at a front 332 of housing 322. A handle 336 is optionally positioned on a rear 333 of housing 322 to assist with separating developer unit 320 from the corresponding PC unit. Housing 322 also includes a top 334 and a bottom 335.

Reservoir 302 holds the mixture of toner and magnetic carrier beads (the "developer mix"). Developer unit 320 includes an inlet port 338 in fluid communication with reservoir 302 and positioned to receive toner from toner cartridge 200 to replenish reservoir 302 when the toner concentration in reservoir 302 relative to the amount of carrier beads remaining in reservoir 302 gets too low as toner is consumed from reservoir 302 by the printing process. In the example embodiment illustrated, inlet port 338 is positioned on top 334 of housing 322 near side 330; however, inlet port 338 may be positioned at any suitable location on housing 322.

Reservoir 302 includes one or more agitators to stir and move the developer mix. For example, in the embodiment illustrated, reservoir 302 includes a pair of augers 340*a*, 340*b*. Augers 340*a*, 340*b* are arranged to move the developer mix in opposite directions along the axial length of magnetic roll 306. For example, auger 340*a* is positioned to incorporate toner from inlet port 338 and to move the developer mix away from side 330 and toward side 331. Auger 340*b* is positioned to move the developer mix away from side 331, toward side 330 and in proximity to the bottom of magnetic roll 306. This arrangement of augers 340*a*, 340*b* is sometimes informally referred to as a racetrack arrangement because of the circular path the developer mix in reservoir 302 takes when augers 340*a*, 340*b* rotate.

With reference to FIG. 4, magnetic roll 306 includes a core 342 that includes one or more permanent magnets and that does not rotate relative to housing 322. A cylindrical sleeve 344 encircles core 342 and extends along the axial length of magnetic roll 306. In one embodiment, a shaft 346 passes through the center of core 342 and defines an axis of rotation 347 of magnetic roll 306. Shaft 346 is fixed, i.e., shaft 346 does not rotate with sleeve 344 relative to housing 322, and controls the position of core 342 relative to sleeve 344 and to the other components of developer unit 320. With reference back to FIG. 3, a rotatable end cap 345 is positioned at one axial end of magnetic roll 306, referred to as the drive side of magnetic roll 306. End cap 345 is coupled to sleeve 344 such that rotation of end cap 345 causes sleeve 344 to rotate around core 342. Sleeve 344 rotates in a clockwise direction as viewed in FIG. 4 to transport the developer mix from reservoir 302 to PC drum 310. A drive coupler 350 is operatively connected to end cap 345 either directly, such as on an end of a shaft 349 that extends axially outward from end cap 345 as shown in the example embodiment illustrated, or indirectly. Drive coupler 350 is positioned to receive rotational force from a corresponding drive coupler in image forming device 100 when developer unit 320 is installed in image forming device 100. Any suitable drive coupler 350 may be used as desired, such as a spur gear or a drive coupler that receives rotational force at its axial end. In one embodiment, augers 340*a*, 340*b* are operatively connected to drive coupler 350 by one or more intermediate gears (not shown). Alternatively, augers 340*a*, 340*b* may be driven independently of drive coupler 350 and sleeve 344 by a second drive coupler positioned to receive rotational force from a corresponding drive coupler in image forming device 100 when developer unit 320 is installed in image forming device 100.

Figure 5:
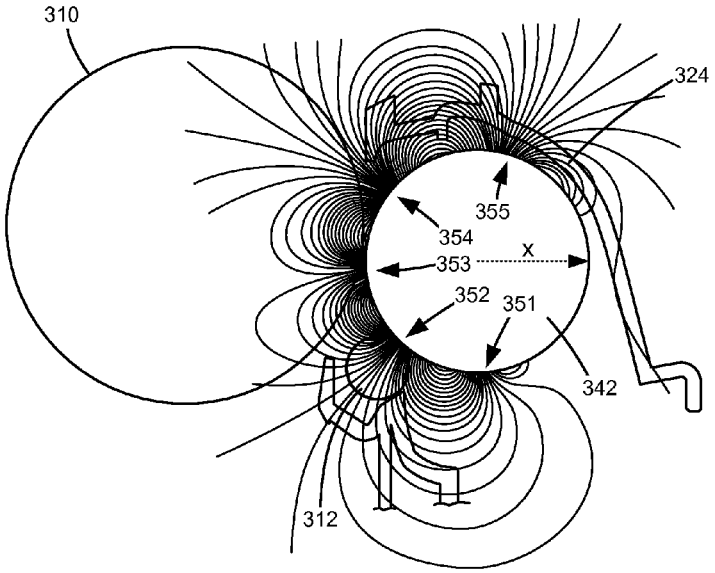
FIG. 5 is a schematic diagram of the developer unit of FIGS. 3 and 4 showing the magnetic field lines of a magnetic roll according to one example embodiment.

With reference to FIGS. 4 and 5, the permanent magnet(s) of core 342 produce a series of circumferentially spaced, alternating (south v. north) magnetic poles that facilitate the transport of developer mix to PC drum 310 as sleeve 344 rotates. FIG. 5 shows the magnetic field lines generated by the magnetic poles of core 342 according to one example embodiment. Core 342 includes a pickup pole 351 positioned near the bottom of core 342 (near the 6 o'clock position of core 342 as viewed in FIG. 5). Pickup pole 351 magnetically attracts developer mix in reservoir 302 to the outer surface of sleeve 344. The magnetic attraction from core 342 causes the developer mix to form cone or bristle-like chains that extend from the outer surface of sleeve 344 along the magnetic field lines.

After the developer mix is picked up at pickup pole 351, as sleeve 344 rotates, the developer mix on sleeve 344 advances toward a trim bar 312. Trim bar 312 is positioned in close proximity to the outer surface of sleeve 344. Trim bar 312 trims the chains of developer mix as they pass to a predetermined average height defined by a trim bar gap 314 formed between trim bar 312 and the outer surface of sleeve 344 in order to control the mass of developer mix on the outer surface of sleeve 344. Trim bar gap 314 dictates how much developer mix is allowed to pass on the outer surface of sleeve 344 from reservoir 302 toward PC drum 310. Trim bar 312 may be magnetic or non-magnetic and may take a variety of different shapes including having a flat or rounded trimming surface. Trim bar 312 may be electrically biased to aid in trimming the chains of developer mix. Core 342 includes a trim pole 352 positioned at trim bar 312 to stand the chains of developer mix up on sleeve 344 in a generally radial orientation for trimming by trim bar 312. As shown in FIG. 5, between pickup pole 351 and trim pole 352, the chains of developer mix on sleeve 344 have a primarily tangential (as opposed to radial) orientation relative to the outer surface of sleeve 344 according to the magnetic field lines between pickup pole 351 and trim pole 352.

As sleeve 344 rotates further, the developer mix on sleeve 344 passes in close proximity to the outer surface of PC drum 310. As discussed above, electrostatic forces from the latent image formed on PC drum 310 by the laser beam from LSU 112 strip the toner from the carrier beads to form a toned image on the surface of PC drum 310. Core 342 includes a developer pole 353 positioned at the point where the outer surface of sleeve 344 passes in close proximity to the outer surface of PC drum 310 to once again stand the chains of developer mix up on sleeve 344 in a generally radial orientation to promote the transfer of toner from sleeve 344 to PC drum 310. The developer mix is less dense and less coarse when the chains of developer mix are stood up in a generally radial orientation than it is when the chains are more tangential. As a result, less wear occurs on the surface of PC drum 310 from contact between PC drum 310 and the chains of developer mix when the chains of developer mix on sleeve 344 are in a generally radial orientation.

As sleeve 344 continues to rotate, the remaining developer mix on sleeve 344, including the toner not transferred to PC drum 310 and the carrier beads, is carried by magnetic roll 306 past PC drum 310 and back toward reservoir 302. Core 342 includes a transport pole 354 positioned past the point where the outer surface of sleeve 344 passes in close proximity to the outer surface of PC drum 310. Transport pole 354 magnetically attracts the remaining developer mix to sleeve 344 to prevent the remaining developer mix from migrating to PC drum 310 or otherwise releasing from sleeve 344. As sleeve 344 rotates further, the remaining developer mix passes under lid 324 and is carried back to reservoir 302 by magnetic roll 306. Core 342 includes a release pole 355 positioned near the top of core 342 along the direction of rotation of sleeve 344. Release pole 355 magnetically attracts the remaining developer mix to sleeve 344 as the developer mix is carried the remaining distance to the point where it is released back into reservoir 302. As the remaining developer mix passes the 2 o'clock position of core 342 as viewed in FIG. 5, the developer mix is no longer magnetically retained against sleeve 344 by core 342 allowing the developer mix to fall via gravity and centrifugal force back into reservoir 302.

Figure 6:
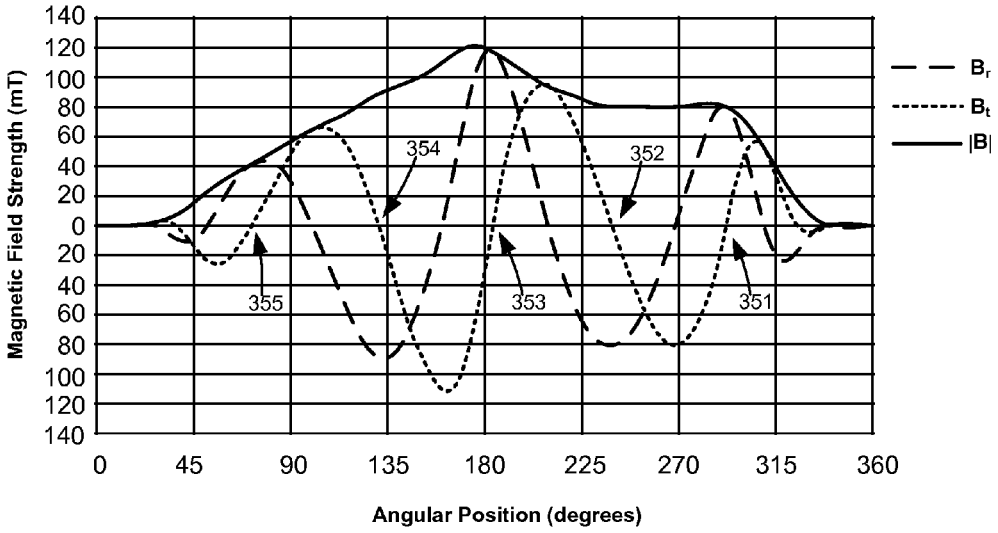
FIG. 6 is a graph of magnetic field strength versus angular position illustrating the magnetic profile of the magnetic roll according to one example embodiment.
Figure 7A:
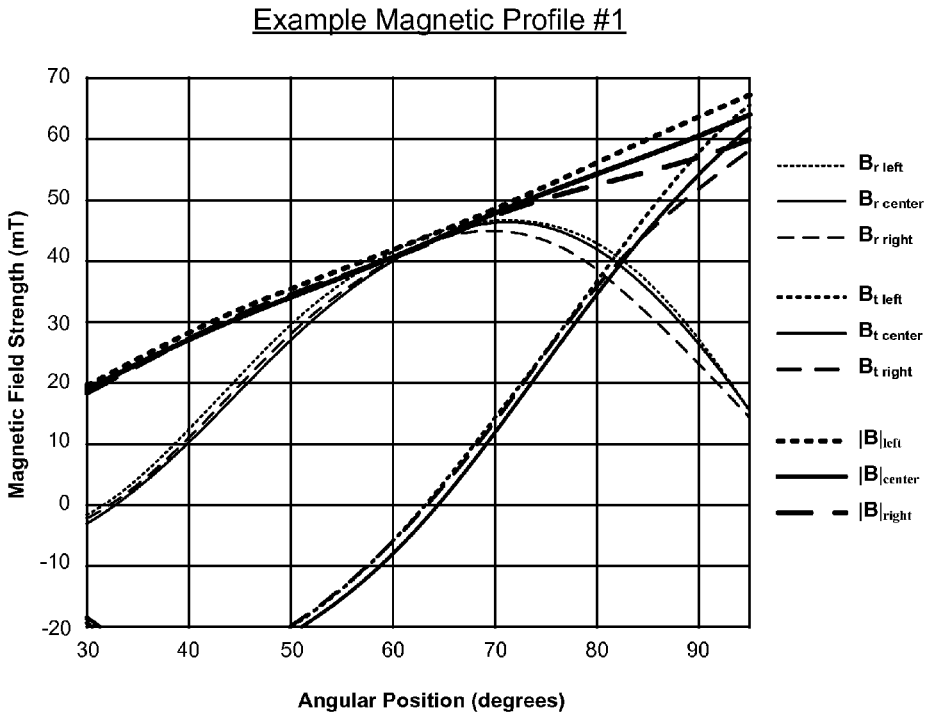
FIG. 7A is a graph of magnetic field strength versus angular position for a first example magnetic profile.
Figure 7B:
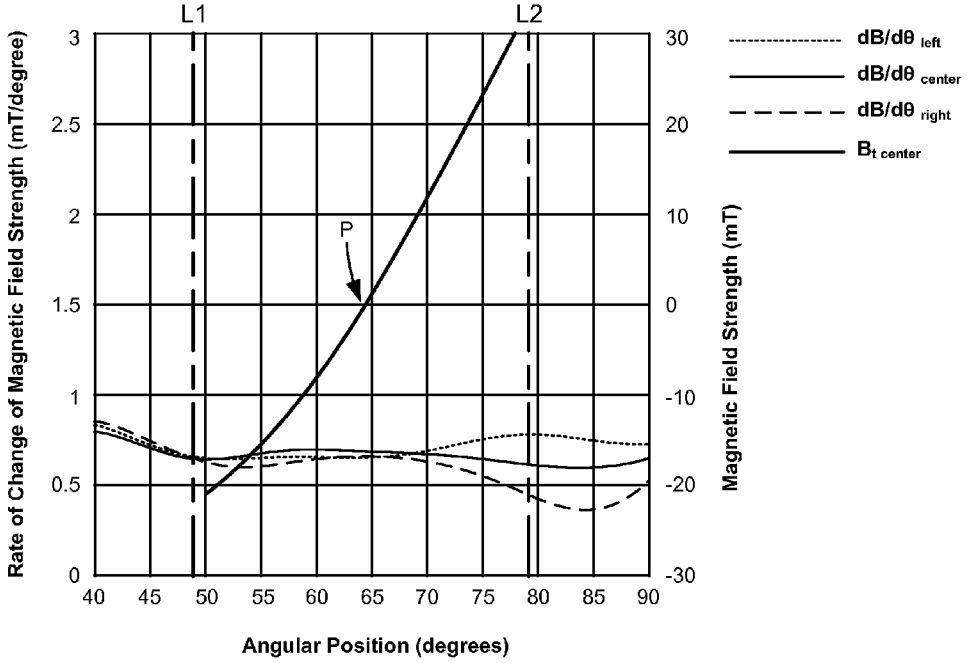
FIG. 7B is a graph of the rate of change of the magnitude of the total magnetic field strength versus angular position and a tangential component of the magnetic field versus angular position for the first example magnetic profile.
Figure 8A:
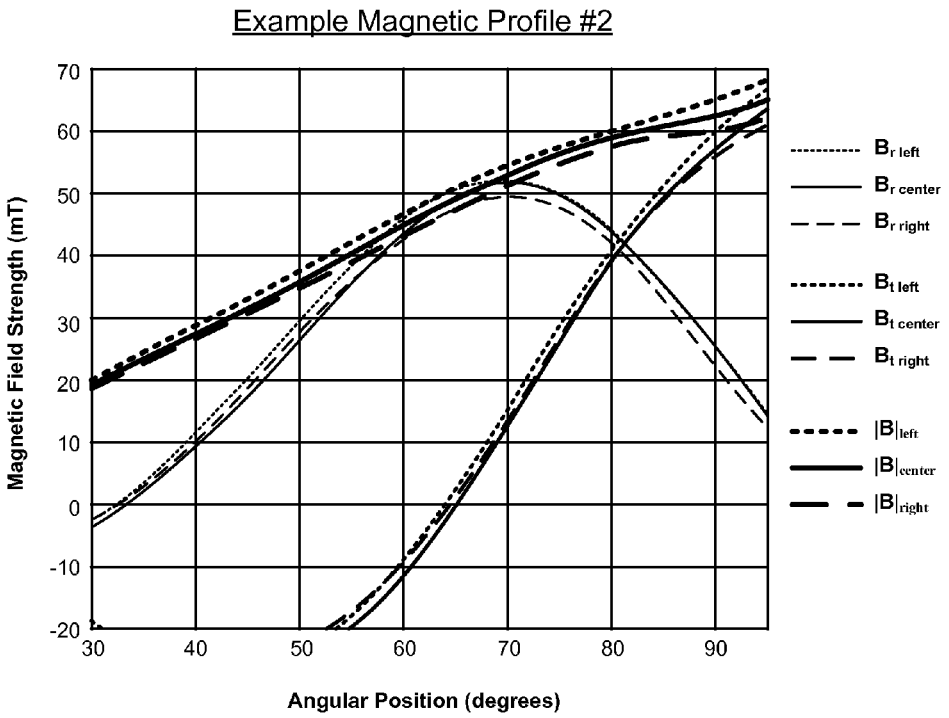
FIG. 8A is a graph of magnetic field strength versus angular position for a second example magnetic profile.
Figure 8B:
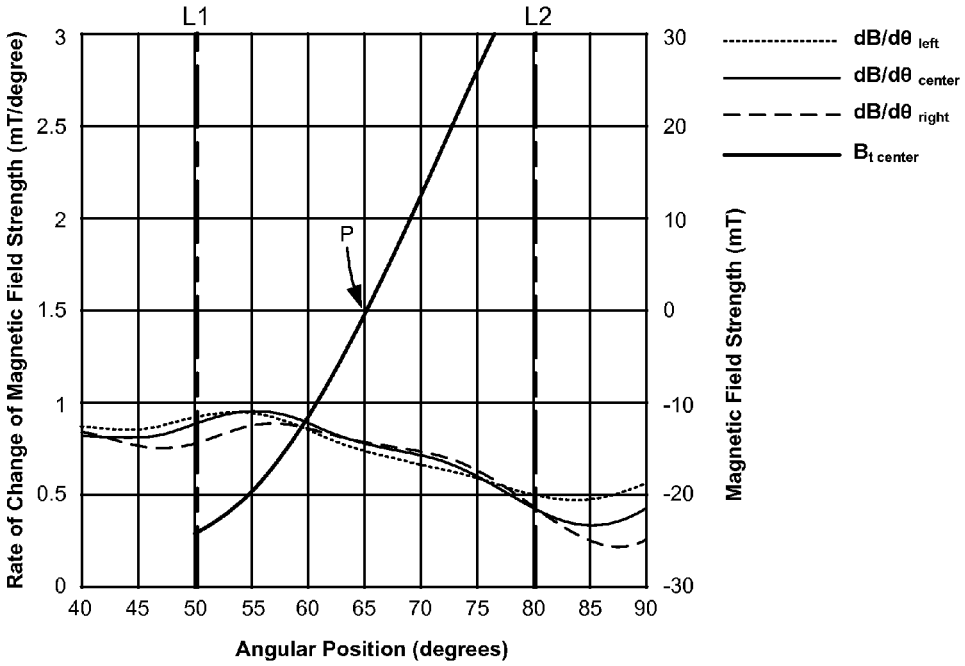
FIG. 8B is a graph of the rate of change of the magnitude of the total magnetic field strength versus angular position and a tangential component of the magnetic field versus angular position for the second example magnetic profile.
Figure 9A:
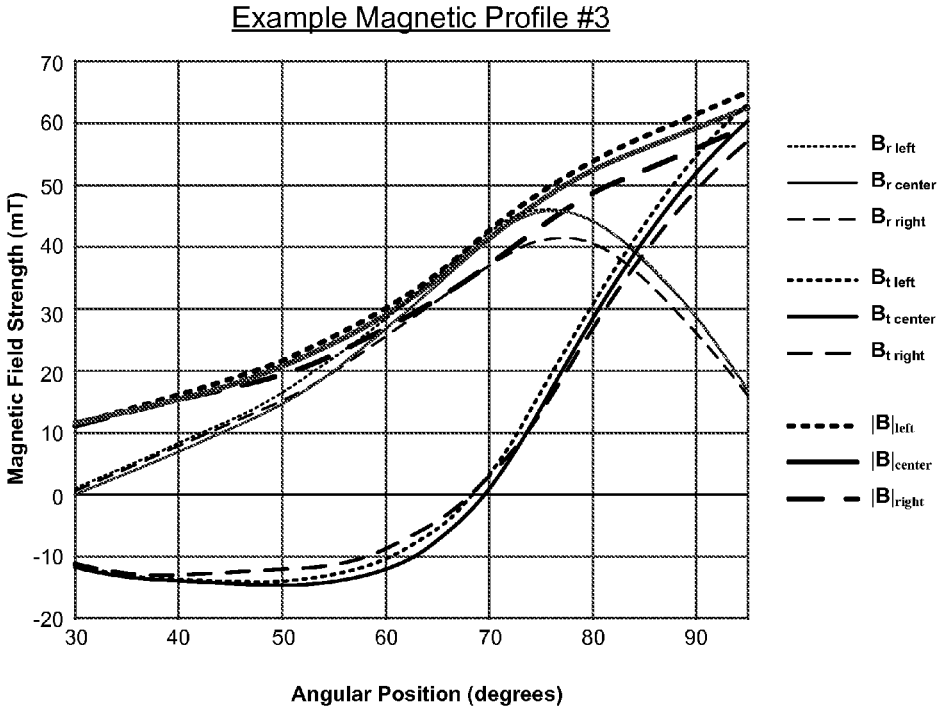
FIG. 9A is a graph of magnetic field strength versus angular position for a third example magnetic profile.
Figure 9B:
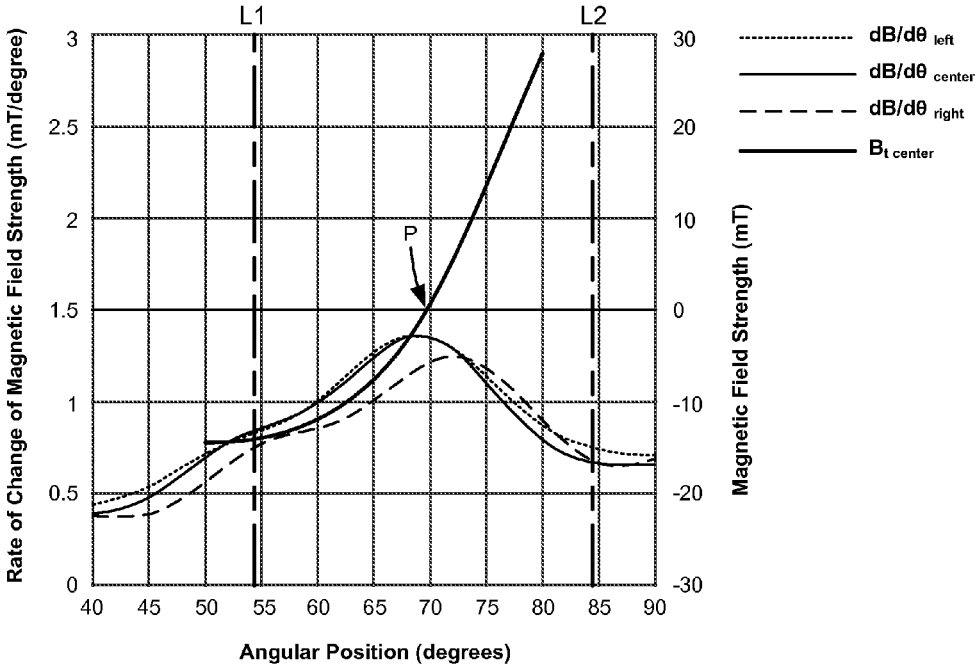
FIG. 9B is a graph of the rate of change of the magnitude of the total magnetic field strength versus angular position and a tangential component of the magnetic field versus angular position for the third example magnetic profile.
Figure 10A:
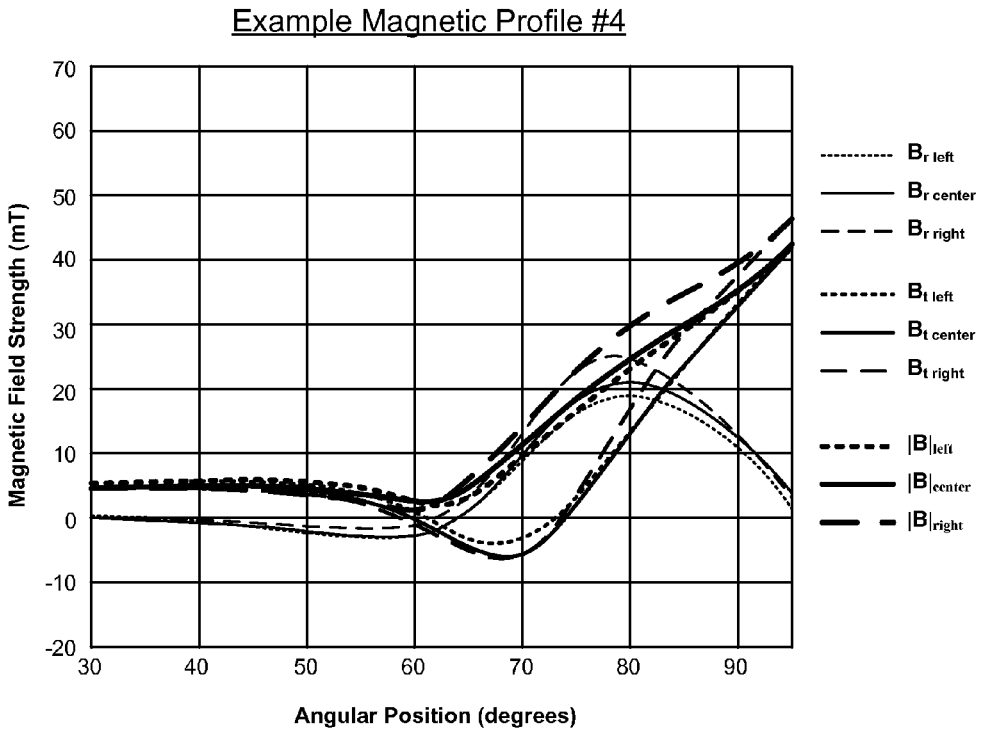
FIG. 10A is a graph of magnetic field strength versus angular position for a fourth example magnetic profile.
Figure 10B:
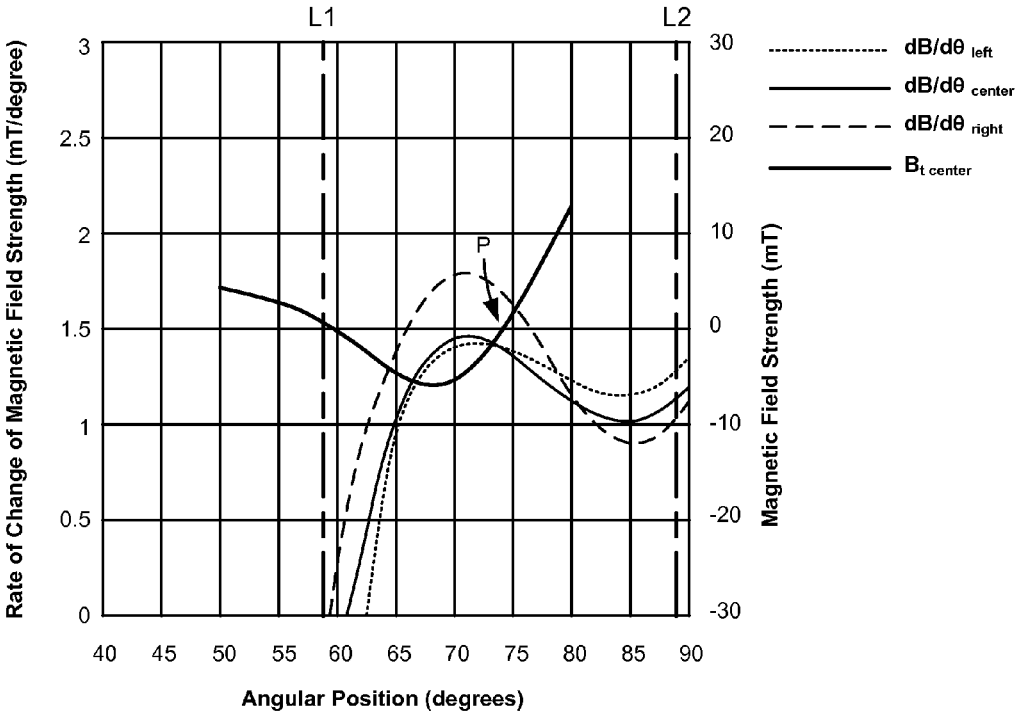
FIG. 10B is a graph of the rate of change of the magnitude of the total magnetic field strength versus angular position and a tangential component of the magnetic field versus angular position for the fourth example magnetic profile.
Figure 11A:
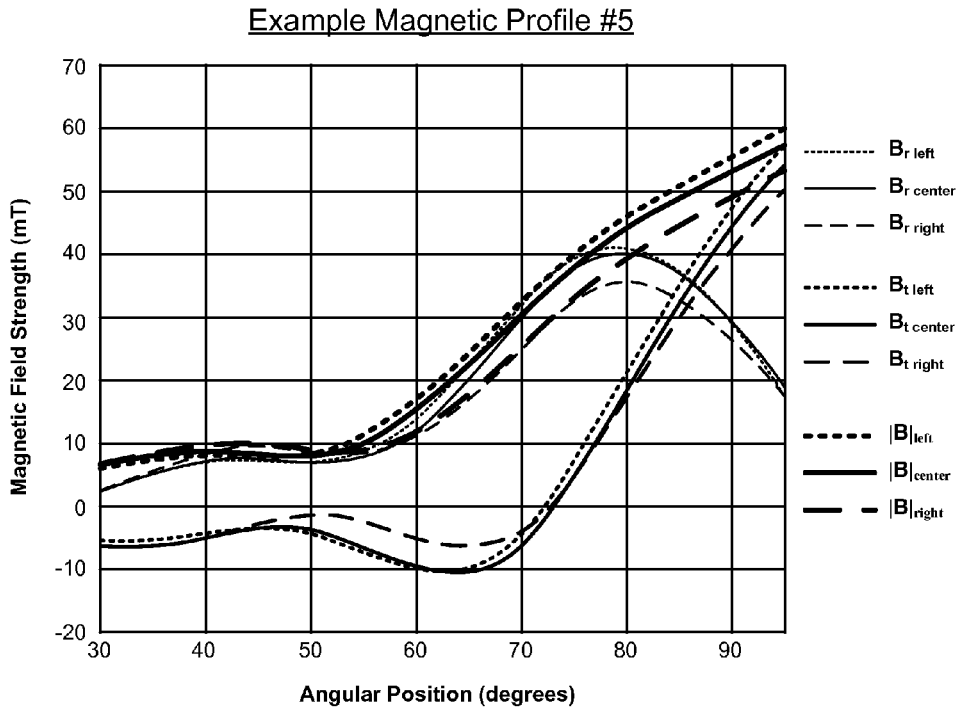
FIG. 11A is a graph of magnetic field strength versus angular position for a fifth example magnetic profile.
Figure 11B:
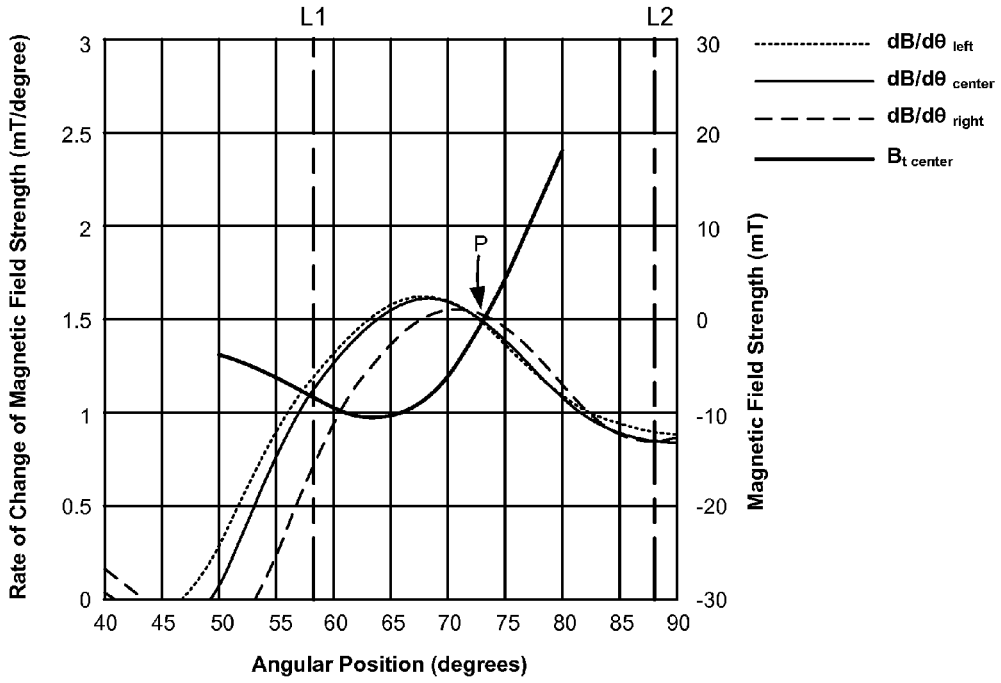
FIG. 11B is a graph of the rate of change of the magnitude of the total magnetic field strength versus angular position and a tangential component of the magnetic field versus angular position for the fifth example magnetic profile.
Figure 12A:
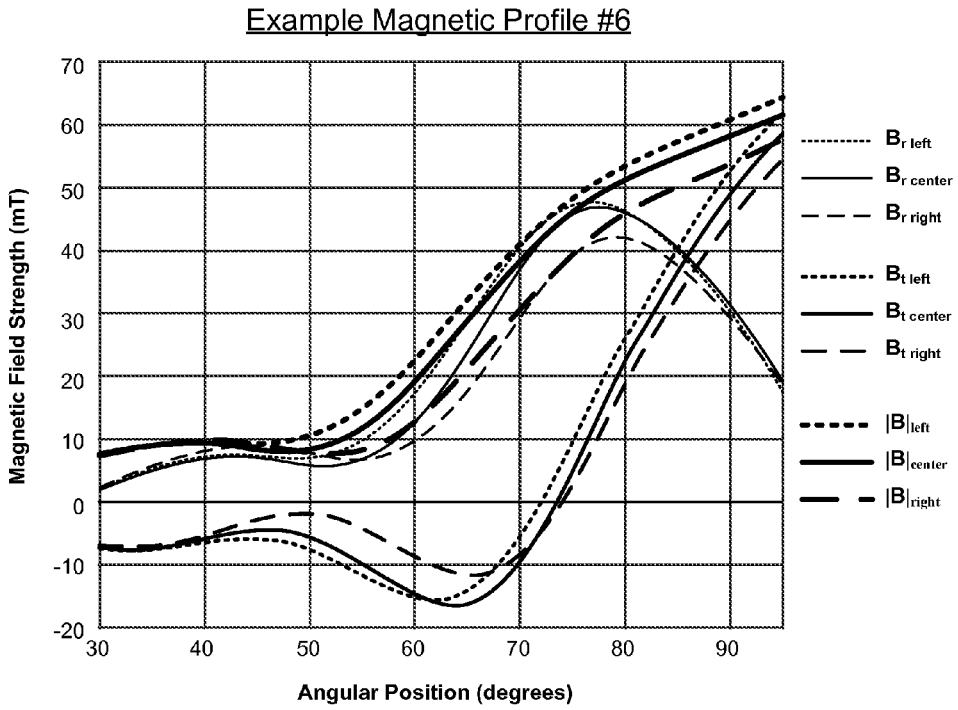
FIG. 12A is a graph of magnetic field strength versus angular position for a sixth example magnetic profile.
Figure 12B:
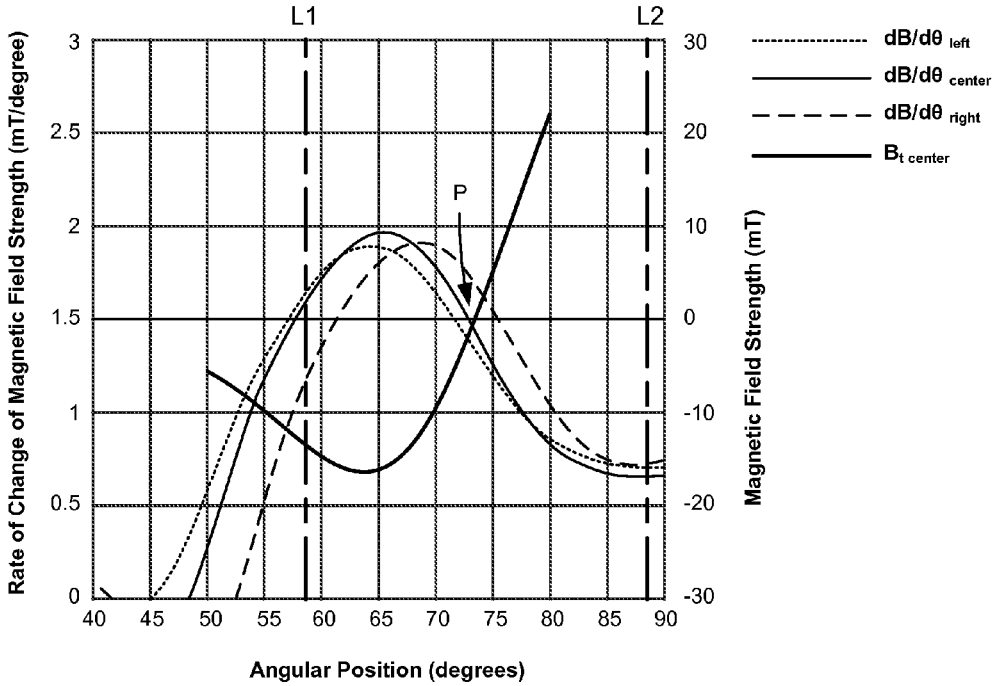
FIG. 12B is a graph of the rate of change of the magnitude of the total magnetic field strength versus angular position and a tangential component of the magnetic field versus angular position for the sixth example magnetic profile.
Figure 13A:
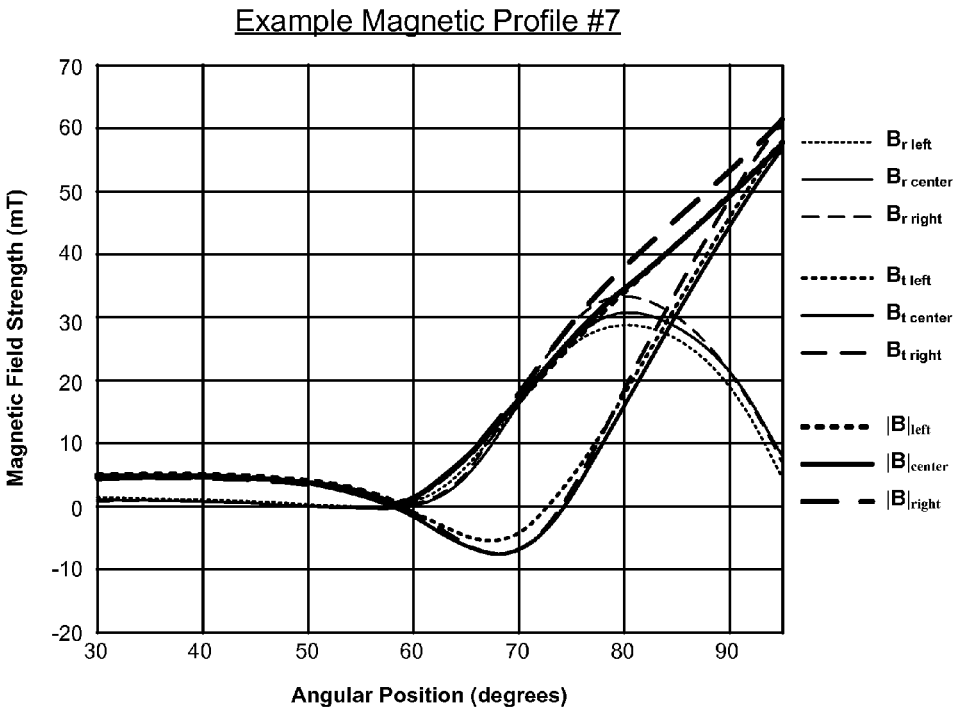
FIG. 13A is a graph of magnetic field strength versus angular position for a seventh example magnetic profile.
Figure 13B:
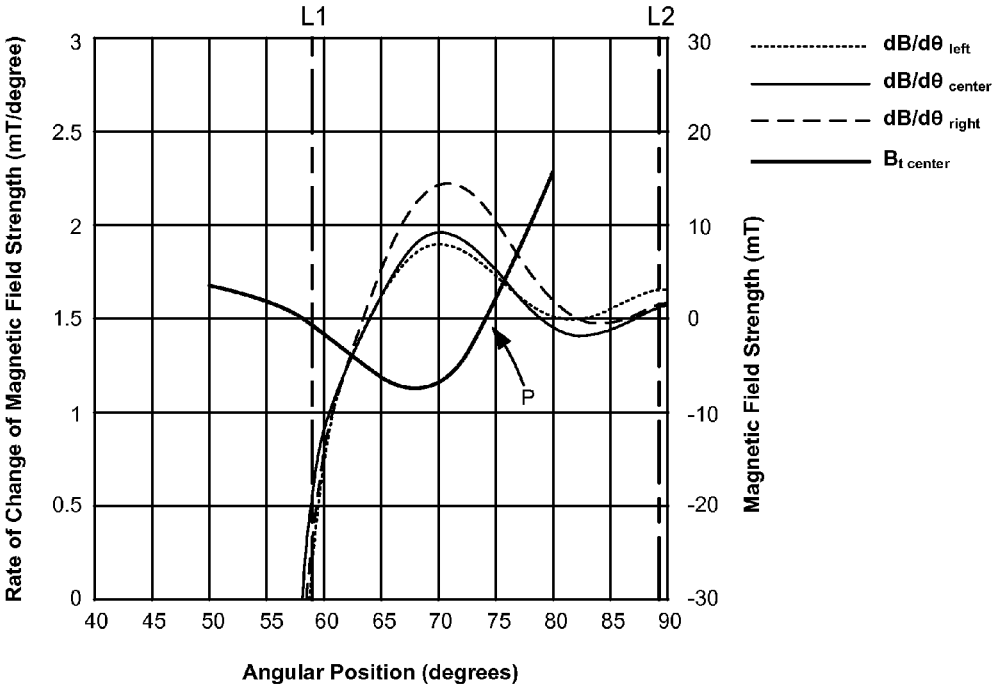
FIG. 13B is a graph of the rate of change of the magnitude of the total magnetic field strength versus angular position and a tangential component of the magnetic field versus angular position for the seventh example magnetic profile.
Figure 14A:
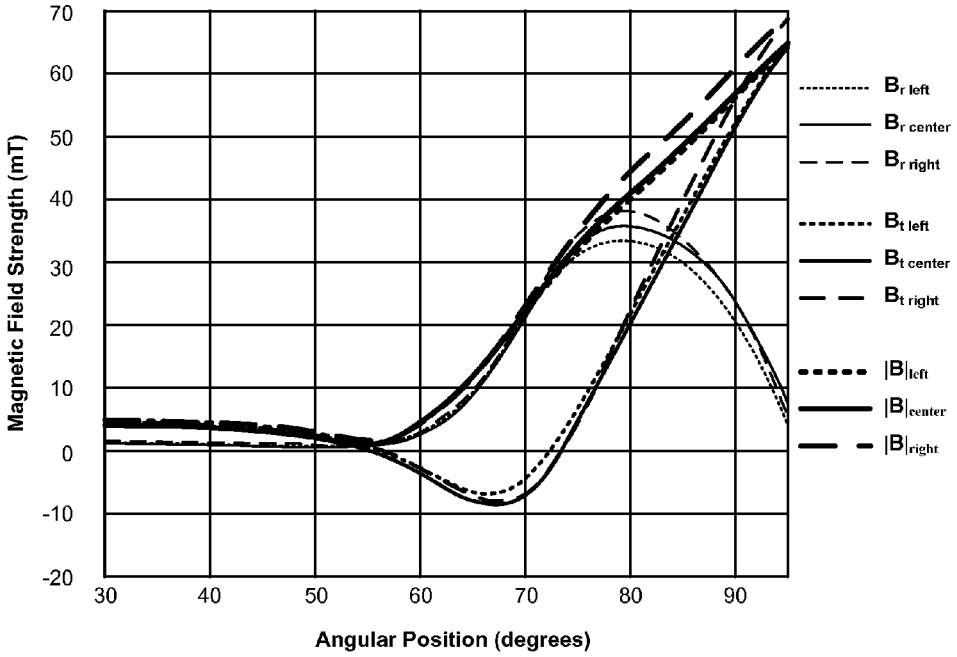
FIG. 14A is a graph of magnetic field strength versus angular position for a eighth example magnetic profile.
Figure 14B:
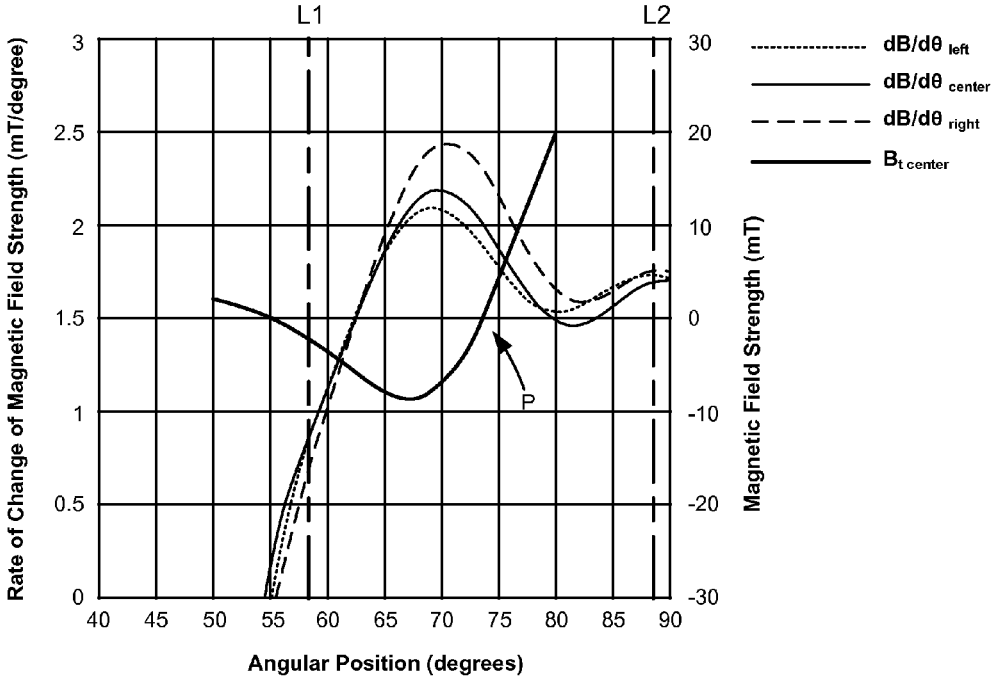
FIG. 14B is a graph of the rate of change of the magnitude of the total magnetic field strength versus angular position and a tangential component of the magnetic field versus angular position for the eighth example magnetic profile.

FIG. 6 is a graph illustrating the magnetic profile of core 342 of magnetic roll 306 according to one example embodiment. FIG. 6 is a graph of the magnetic field strength (in milli-tesla (mT)) versus angular position (in degrees) at an axial point on magnetic roll 306 positioned axially inward from the axial ends of core 342, where the axial component of the magnetic field is near zero, e.g., <1 mT. FIG. 6 shows the magnetic field strength values at the outer surface of sleeve 344. The 0 degree position on the x-axis of FIG. 6 corresponds to the horizontal radius of core 342 (labeled "x" in FIG. 5) that faces away from PC drum 310 when developer unit 320 is in its operating position. The angular position values listed on the x-axis of FIG. 6 increase in a direction counter to the rotational direction of sleeve 344 (counter-clockwise as viewed in FIGS. 4 and 5). The poles 351-355 of magnetic roll 306 are labeled in FIG. 6 with release pole 355 positioned to the far left, closest to 0 degrees, and pickup pole 351 positioned to the far right, closest to 360 degrees. Three lines are included in FIG. 6 showing the radial component of the magnetic field ($B_r$), the tangential component of the magnetic field ($B_t$) and the magnitude of the total magnetic field strength ($|B|$). As shown in FIG. 6, poles 351-355 alternate north and south in polarity.

The total magnetic field strength is highest near developer pole 353 in order to strongly attract the magnetic carrier beads to sleeve 344 and reduce the occurrence of magnetic carrier beads releasing from sleeve 344 to PC drum 310 during the transfer of toner from the developer mix on sleeve 344 to PC drum 310. Generally, the magnitude of the total magnetic field strength must decrease significantly in the direction of rotation of sleeve 344 from developer pole 353 to release pole 355 (e.g., to below 10-15 mT) in order for the magnetic carrier beads to separate from sleeve 344 and release back into reservoir 302.

It was observed that where the magnitude of the total magnetic field strength decreases too abruptly in the direction of rotation of sleeve 344 near release pole 355, a magnetic gradient force is generated on the developer mix opposite in direction to the rotation of sleeve 344, toward the higher magnetic field magnitude. When the magnetic field lines have a radial or mostly radial orientation, such as in the area of release pole 355, the developer mix tends to form individual bristle-like chains that stand apart from each other as a result of mutual magnetic repulsion. The open spaces between the chains make it possible for the chains to undergo retrograde motion, moving opposite the rotation of sleeve 344, as a result of the magnetic gradient force. Sliding friction between the developer mix and the surface of sleeve 344 as the developer mix moves opposite the rotation of sleeve 344 increases the wear on the magnetic carrier beads and toner particles which, in turn, may reduce the useful life of developer unit 320. Further, movement of developer mix opposite the rotation of sleeve 344 can result in the accumulation of developer mix near release pole 355. The accumulation of developer mix near release pole 355 may tend to knock the chains of developer mix near release pole 355 off of sleeve 344 causing the developer mix to spray from sleeve 344 against the inner surface of lid 324 instead of allowing the developer mix to smoothly release from sleeve 344 and drop back into reservoir 302. The spray of developer mix against lid 324 increases the risk of leakage and may result in additional wear on the magnetic carrier beads and toner particles.

In contrast, it was observed that gradual and consistent reduction of the magnitude of the total magnetic field strength in the direction of rotation of sleeve 344 near release pole 355 reduces the occurrence of retrograde motion of developer mix near release pole 355 thereby reducing the wear on the magnetic carrier beads and toner particles and the spray of developer mix. Accordingly, at the portions of magnetic roll 306 positioned axially inward from the axial ends of core 342 where the axial component of the magnetic field is near zero, the magnitude of the total magnetic field strength of core 342 of the present disclosure decreases by 1.5 mT/degree or less in the direction of rotation of sleeve 344 at a radius of 0.5 mm radially beyond the outer surface of sleeve 344 throughout the area of release pole 355, which includes ±15 degrees from the angular position of magnetic roll 306 at which the tangential component of the magnetic field is equal to zero at release pole 355. In some embodiments, at the portions of magnetic roll 306 positioned axially inward from the axial ends of core 342, the magnitude of the total magnetic field strength of core 342 decreases by 1.3 mT/degree or less, or 1.0 mT/degree or less, in the direction of rotation of sleeve 344 at a radius of 0.5 mm radially beyond the outer surface of sleeve 344 throughout the area of release pole 355. Theoretically, there is no lower limit on the magnitude of the rate of change of the magnitude of the total magnetic field strength near release pole 355; however, the magnitude of the total magnetic field strength near release pole 355 should decrease rapidly enough to provide a region of near zero magnetic field strength between release pole 355 and pickup pole 351.

FIGS. 7A-14B illustrate eight example magnetic profiles (Example Magnetic Profiles #1-8) of magnetic rolls that were tested and analyzed for retrograde motion of developer mix near their release poles. FIGS. 7A, 8A, 9A, 10A, 11A, 12A, 13A and 14A are graphs of the magnetic field strength (in mT) versus angular position (in degrees) near the release pole for each magnetic profile at a position axially inward from the axial ends of the core, where the axial component of the magnetic field is near zero. FIGS. 7A, 8A, 9A, 10A, 11A, 12A, 13A and 14A show the magnetic field strength values at a radius of 0.5 mm beyond the outer surface of the sleeve of the magnetic roll. Chains of developer mix formed on the outer surface of the sleeve are typically 1.0 mm-1.4 mm in length when the chains stand up radially on the outer surface of the sleeve. Accordingly, a radius of 0.5 mm beyond the outer surface of the sleeve represents roughly the middle of the chains of developer mix near the release pole. The 0 degree position on the x-axis of FIGS. 7A, 8A, 9A, 10A, 11A, 12A, 13A and 14A (like FIG. 6) corresponds to the horizontal radius of the core that faces away from the PC drum when the developer unit is in its operating position. The angular position values listed on the x-axis of FIGS. 7A, 8A, 9A, 10A, 11A, 12A, 13A and 14A (like FIG. 6) increase in a direction counter to the rotational direction of the sleeve. Nine lines are included in each of FIGS. 7A, 8A, 9A, 10A, 11A, 12A, 13A and 14A. Three lines show the radial component of the magnetic field at a point axially in the center of the magnetic roll ($B_{r\ center}$), at a point to the right of the center of the magnetic roll but axially inward from the right axial end of the magnetic roll ($B_{r\ right}$) and at a point to the left of the center of the magnetic roll but axially inward from the left axial end of the magnetic roll ($B_{r\ left}$). Three lines show the tangential component of the magnetic field at the same three axial points of the magnetic roll ($B_{t\ center}$, $B_{t\ right}$, $B_{t\ left}$) and three lines show the magnitude of the total magnetic field strength at the same three axial points of the magnetic roll ($|B|_{center}$, $|B|_{right}$, $|B|_{left}$).

The tangential and radial components of the magnetic field near the outer surface of sleeve 344 may both be measured individually, e.g., using a Hall probe as is known in the art. Where the axial component of the magnetic field is near zero, the magnitude of the total magnetic field strength can then be calculated according to Equation 1, as is known in the art.

$$|B| = \sqrt{B_r^2 + B_t^2} \tag{1}$$

Alternatively, the radial component of the magnetic field may be measured and the expected tangential component may be calculated according to the Fourier series equations below, as is also known in the art. Axially inward from the axial ends of core 342, where the axial component of the magnetic field is near zero, the radial and tangential components of the magnetic field can be represented as periodic functions of the angular position (θ) and the radius (r) from the axis of rotation of the magnetic roll. Once the radial component of the magnetic field has been measured at a constant radius, the equations below can be used to calculate the expected radial and tangential components of the magnetic field at any radius and angular position. Equation 1 above may then be used to calculate the magnitude of the total magnetic field strength at that radius and angular position. It is preferred to perform the initial radial component measurement at a radius that is close to the outer surface of the sleeve of the magnetic roll in order to maximize the signal to noise ratio in the measured values. In the equations below, Δθ represents the angular interval at which radial component measurements are taken. This measurement interval is preferably less than 1 degree. In the equations below, n is an integer that represents a frequency harmonic used to calculate the magnetic field and $N_{max}$ is a user specified variable that represents the highest frequency harmonic used. Typically, $14<N_{max}<30$. The optimum $N_{max}$ value varies with the particular shape of the magnetic profile being measured. The measured radial components may be compared with radial components calculated according to the equations below in order to determine the highest harmonic $N_{max}$ necessary to closely match the measured profile.

Fourier coefficients $a_n$ and $b_n$ are calculated according to Equations 2 and 3 below for each n value based on the measured radial components of the magnetic field ($B_r$) at the angular positions (θ) measured and the constant radius (r) of measurement.

$$a_n = \frac{r^{n+1}}{180}\Delta\theta\sum_{\theta=0}^{360} B_r\cos(n\theta) \tag{2}$$

$$b_n = \frac{r^{n+1}}{180}\Delta\theta\sum_{\theta=0}^{360} B_r\sin(n\theta) \tag{3}$$

Once the coefficients $a_n$ and $b_n$ have been calculated, the radial and tangential components of the magnetic field may be calculated at any radius and angular position using Equations 4 and 5 below.

$$B_r(r,\theta) = \sum_{n=1}^{Nmax} \frac{a_n}{r_{calc}^{n+1}}\cos(n\theta) + \frac{b_n}{r_{calc}^{n+1}}\sin(n\theta) \tag{4}$$

$$B_t(r,\theta) = \sum_{n=1}^{Nmax} \frac{a_n}{r_{calc}^{n+1}}\sin(n\theta) - \frac{b_n}{r_{calc}^{n+1}}\cos(n\theta) \tag{5}$$

Equation 1 above may then be used to calculate the magnitude of the total magnetic field strength at a particular radius and angular position.

FIGS. 7B, 8B, 9B, 10B, 11B, 12B, 13B and 14B are graphs of the rate of change of the magnitude of the total magnetic field strength (in mT/degree) versus angular position (in degrees) for each of the magnetic profiles. Three lines ($dB/d\theta_{center}$, $dB/d\theta_{right}$, $dB/d\theta_{left}$) are included in each of FIGS. 7B, 8B, 9B, 10B, 11B, 12B, 13B and 14B depicting the rate of change of the magnitude of the total magnetic field strength versus angular position at each of the three axial points of the magnetic roll in FIGS. 7A, 8A, 9A, 10A, 11A, 12A, 13A and 14A. In other words, FIGS. 7B, 8B, 9B, 10B, 11B, 12B, 13B and 14B are graphs of the slope of each the three lines depicting the magnitude of the total magnetic field strength (|B|) shown in FIGS. 7A, 8A, 9A, 10A, 11A, 12A, 13A and 14A plotted versus angular position. FIGS. 7B, 8B, 9B, 10B, 11B, 12B, 13B and 14B also include the tangential component of the magnetic field at the point axially in the center of the magnetic roll ($B_{t\ center}$) versus angular position in order to show where the tangential component of the magnetic field is equal to zero at the release pole, which is indicated by the reference letter P in each of FIGS. 7B, 8B, 9B, 10B, 11B, 12B, 13B and 14B. FIGS. 7B, 8B, 9B, 10B, 11B, 12B, 13B and 14B also include a pair of vertical lines, which are indicated by the reference letters L1 and L2, indicating the area of the release pole that is ±15 degrees from the angular position at which the tangential component of the magnetic field at the point axially in the center of the magnetic roll ($B_{t\ center}$) is equal to zero at the release pole.

Each of the magnetic rolls depicted in FIGS. 7A-14B was visually examined for retrograde motion of developer mix near its release pole. Table 1 below shows the results of those examinations.

TABLE 1

| Magnetic Profile | Retrograde Motion? |
|---|---|
| Example Magnetic Profile #1 | No retrograde motion |
| Example Magnetic Profile #2 | No retrograde motion |
| Example Magnetic Profile #3 | No retrograde motion |
| Example Magnetic Profile #4 | Light retrograde motion |
| Example Magnetic Profile #5 | Moderate retrograde motion |
| Example Magnetic Profile #6 | Moderate retrograde motion |
| Example Magnetic Profile #7 | Strong retrograde motion |
| Example Magnetic Profile #8 | Strong retrograde motion |

As illustrated in FIG. 7A-14B, the magnitude of the rate of change of the magnitude of the total magnetic field strength near the release pole increases from Example Magnetic Profile #1 to Example Magnetic Profile #8. Example Magnetic Profiles #1 and #2 include a magnitude of the rate of change of the magnitude of the total magnetic field strength that remains below 1.0 mT/degree throughout the area of the release pole and exhibited no retrograde motion. Example Magnetic Profile #3 includes a magnitude of the rate of change of the magnitude of the total magnetic field strength that peaks at about 1.3 mT/degree in the area of the release pole and also exhibited no retrograde motion. Example Magnetic Profile #4 includes a magnitude of the rate of change of the magnitude of the total magnetic field strength that approaches 1.5 mT/degree in the area of the release pole at the left and the center of the magnetic roll and that exceeds 1.5 mT/degree in the area of the release pole at the right of the magnetic roll. Example Magnetic Profile #4 exhibited light retrograde motion. Example Magnetic Profiles #5 and #6 include a magnitude of the rate of change of the magnitude of the total magnetic field strength between 1.5 mT/degree and 2.0 mT/degree in the area of the release pole and exhibited moderate retrograde motion. Example Magnetic Profiles #7 and #8 include a magnitude of the rate of change of the magnitude of the total magnetic field strength that exceeds 2.0 mT/degree in the area of the release pole and exhibited strong retrograde motion.

Accordingly, it can be seen from Example Magnetic Profiles #1-8 that limiting the magnitude of the rate of change of the magnitude of the total magnetic field strength of core 342 throughout the area of release pole 355 to 1.5 mT/degree or less, and particularly to 1.3 mT/degree or 1.0 mT/degree or less, at a radius of 0.5 mm beyond the outer surface of sleeve 344 reduces the occurrence of retrograde motion of developer mix near release pole 355. Reducing the occurrence of retrograde motion of developer mix near release pole 355 may reduce the wear on the magnetic carrier beads and toner particles and the spray of developer mix thereby increasing the useful life of developer unit 320 and reducing leakage. In contrast, if the magnitude of the rate of change of the magnitude of the total magnetic field strength of core 342 in the area of release pole 355 exceeds 1.5 mT/degree, and particularly 2.0 mT/degree, at a radius of 0.5 mm beyond the outer surface of sleeve 344, magnetic roll 306 is at risk to retrograde motion of the developer mix on the outer surface of sleeve 344 in the area of release pole 355.

The foregoing description illustrates various aspects and examples of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A magnetic roll for transporting a developer mix that includes magnetic carrier beads and toner in a dual component development electrophotographic image forming device, comprising:

a core having at least one permanent magnet having a plurality of circumferentially spaced magnetic poles generating a magnetic field, the plurality of magnetic poles includes a release pole; and a cylindrical sleeve positioned around the core, the sleeve is rotatable relative to the core about an axis of rotation in an operative rotational direction, wherein the release pole is positioned to magnetically attract developer mix to an outer circumferential surface of the sleeve to transport the developer mix on the outer circumferential surface of the sleeve in the operative rotational direction when the sleeve rotates relative to the core to a point where a magnitude of a total magnetic field strength of the magnetic field falls below 15 mT, wherein at portions of the magnetic roll positioned axially inward from axial ends of the core, where an axial component of the magnetic field is <1 mT, the magnitude of the total magnetic field strength of the magnetic field decreases by 1.0 mT/degree or less in the operative rotational direction at a radius of 0.5 mm radially beyond the outer circumferential surface of the sleeve throughout an area of ±15 degrees from an angular position of the magnetic roll at which a tangential component of the magnetic field is equal to zero at the release pole.

2. A developer unit for a dual component development electrophotographic image forming device, comprising:

a housing having a reservoir for storing a developer mix that includes toner and magnetic carrier beads; and a magnetic roll that includes a stationary core and a cylindrical sleeve positioned around the core, the core includes at least one permanent magnet having a plurality of circumferentially spaced magnetic poles generating a magnetic field, the plurality of magnetic poles includes a release pole, the sleeve is rotatable relative to the core about an axis of rotation in an operative rotational direction, an outer circumferential surface of the sleeve is positioned to transport developer mix magnetically attracted from the reservoir to the outer surface of the sleeve by the magnetic field in the operative rotationl direction, the release pole is positioned to magnetically attract developer mix to the outer circumferential surface of the sleeve to transport the developer mix on the outer circumferential surface of the sleeve in the operative rotational direction to a point where the developer mix is released from the outer circumferential surface of the sleeve into the reservoir, wherein at portions of the magnetic roll positioned axially inward from axial ends of the core, where an axial component of the magnetic field is <1 mT, a magnitude of a total magnetic field strength of the magnetic field decreases by 1.0 mT/degree or less in the operative rotational direction at a radius of 0.5 mm radially beyond the outer circumferential surface of the sleeve throughout an area of ±15 degrees from an angular position of the magnetic roll at which a tangential component of the magnetic field is equal to zero at the release pole.

* * * * *